US005078367A

United States Patent [19]

Simpson et al.

[11] Patent Number: 5,078,367

[45] Date of Patent: Jan. 7, 1992

[54] PANEL SYSTEM

[76] Inventors: Alan G. Simpson, Oakley House, Orton Lane, Lower Penn, Wolverhampton, WV4 4AX; Ian A. Simpson, 372 Himley Road, Lower Penn, Dudley, both of England

[21] Appl. No.: 339,613

[22] PCT Filed: Jul. 28, 1988

[86] PCT No.: PCT/GB88/00625

§ 371 Date: May 17, 1989

§ 102(e) Date: May 17, 1989

[87] PCT Pub. No.: WO89/01085

PCT Pub. Date: Feb. 9, 1989

[30] Foreign Application Priority Data

Jul. 31, 1987 [GB] United Kingdom ..... 8718210

[51] Int. Cl.[5] ..... E04H 17/16

[52] U.S. Cl. ..... 256/24; 256/19; 256/73; 52/282

[58] Field of Search ..... 256/24, 19, 73; 52/282

[56] References Cited

U.S. PATENT DOCUMENTS

| | | | |
|---|---|---|---|
| 3,274,641 | 9/1966 | Lien | 18/1 |
| 3,600,867 | 8/1971 | Shuey | 52/284 |
| 3,799,506 | 3/1974 | Schwartz | 256/24 |
| 4,202,532 | 5/1980 | Mills | 256/24 |
| 4,602,765 | 7/1986 | Loper | 256/19 |

FOREIGN PATENT DOCUMENTS

| | | | |
|---|---|---|---|
| 486419 | 9/1974 | Australia . | |
| 2752618 | 5/1979 | Fed. Rep. of Germany . | |
| 398359 | 3/1909 | France . | |
| 2331658 | 10/1977 | France . | |
| 2338368 | 12/1977 | France . | |
| 8400058 | 8/1985 | Netherlands | 256/24 |
| 1522724 | 8/1978 | United Kingdom | 403/295 |
| 1544915 | 4/1979 | United Kingdom . | |
| 1598134 | 9/1981 | United Kingdom . | |

*Primary Examiner*—Andrew V. Kundrat
*Attorney, Agent, or Firm*—Kinney & Lange

[57] ABSTRACT

A panel system for use primarily as a fencing system comprises plastics material posts (4) and plastics material panels assembled from side members (2), intermediate members (3), if necessary, and a plurality of sub-panels (1) framed by the side members (2).

29 Claims, 5 Drawing Sheets

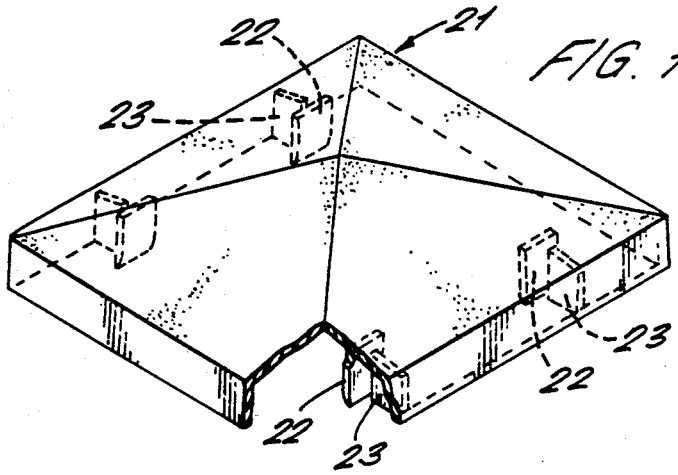
FIG. 11.
FIG. 12.
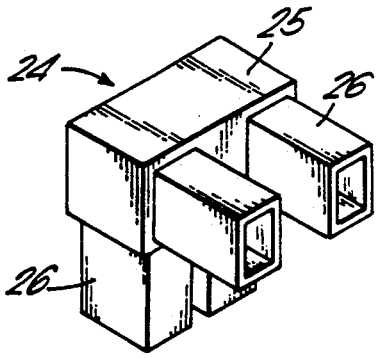
FIG. 9.
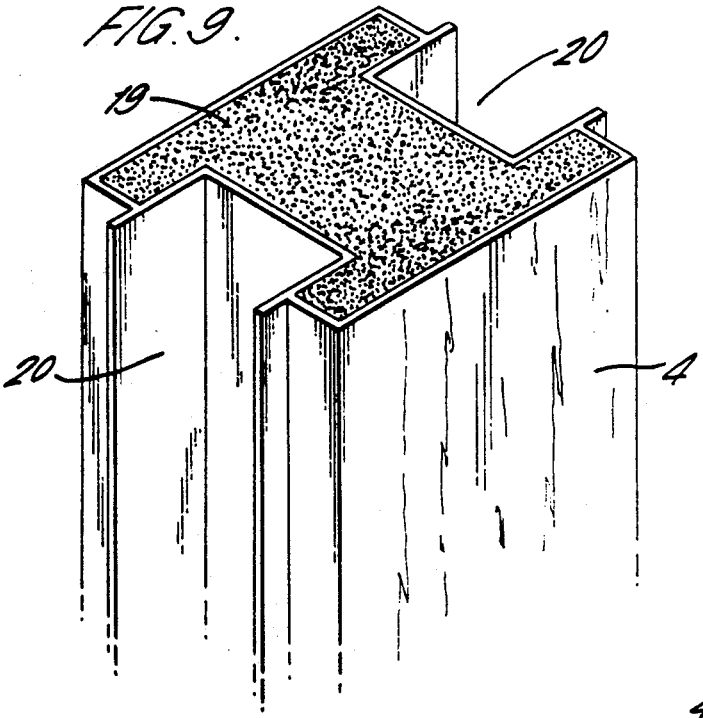
FIG. 10.
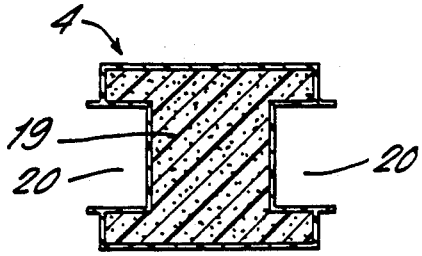

PANEL SYSTEM

This invention relates to a panel system, and particularly but not exclusively to a panel system for use as a fencing system. It will be appreciated, however, that the system of the invention is suitable for providing structures other than fencing, for example partitioning, or sheds or similar structures.

The invention will be described below primarily in relation to a fencing system.

Conventional fencing systems comprise a plurality of posts arranged at spaced intervals in the ground, the space between each pair of adjacent posts being bridged by a panel secured to the posts. The posts can be of wood or concrete, as can the panels. It is also known for concrete panels to be made up from a plurality of sub-panels of manageable size when a single piece panel would be too large and/or heavy to handle. Wooden panels are generally in one piece and are often of such a size that transportation and handling are difficult and expensive. Further, wooden panels and posts require regular treatment in order to prevent decay, and are generally expensive to purchase. Concrete panels and posts are heavy and thus difficult and expensive to handle, even when in sub-panel form, and are also expensive to purchase.

According to this invention there is provided a panel system comprising a plurality of posts and at least one panel for securing between a pair of adjacent posts, in which each post is formed from plastics material and has a channel in at least one edge to receive an edge portion of a panel, and each panel is formed from plastics material and comprises a frame formed from a plurality of similar cross-section side members secured together at corners of the frame, and a plurality of sub-panels secured within the frame.

The invention provides a panel system which is cheap and simple to manufacture, easy to erect, light in weight and the components of which can be of such sizes as to be easily transportable. The system comprises relatively few different components, and such components can be formed from plastics material by extrusion or injection moulding. When in the form of a fencing system the sub-panels can be formed to simulate wooden panels, for example panels of the well known lapped form. When in the form of, for example, a shed, certain of the sub-panels can be formed of transparent or translucent material to provide windows.

This invention will now be described by way of example with reference to the drawings, in which:

FIG. 9 is a perspective view of an end portion of a post used in the assembly of FIG. 1;

FIG. 10 is an end view of the post of FIG. 9;

FIG. 11 is a perspective view, with part broken away, of a cap for the post of FIG. 9; and FIG. 12 is a perspective view of an alternative form of panel frame corner joint member.

Figure 1:
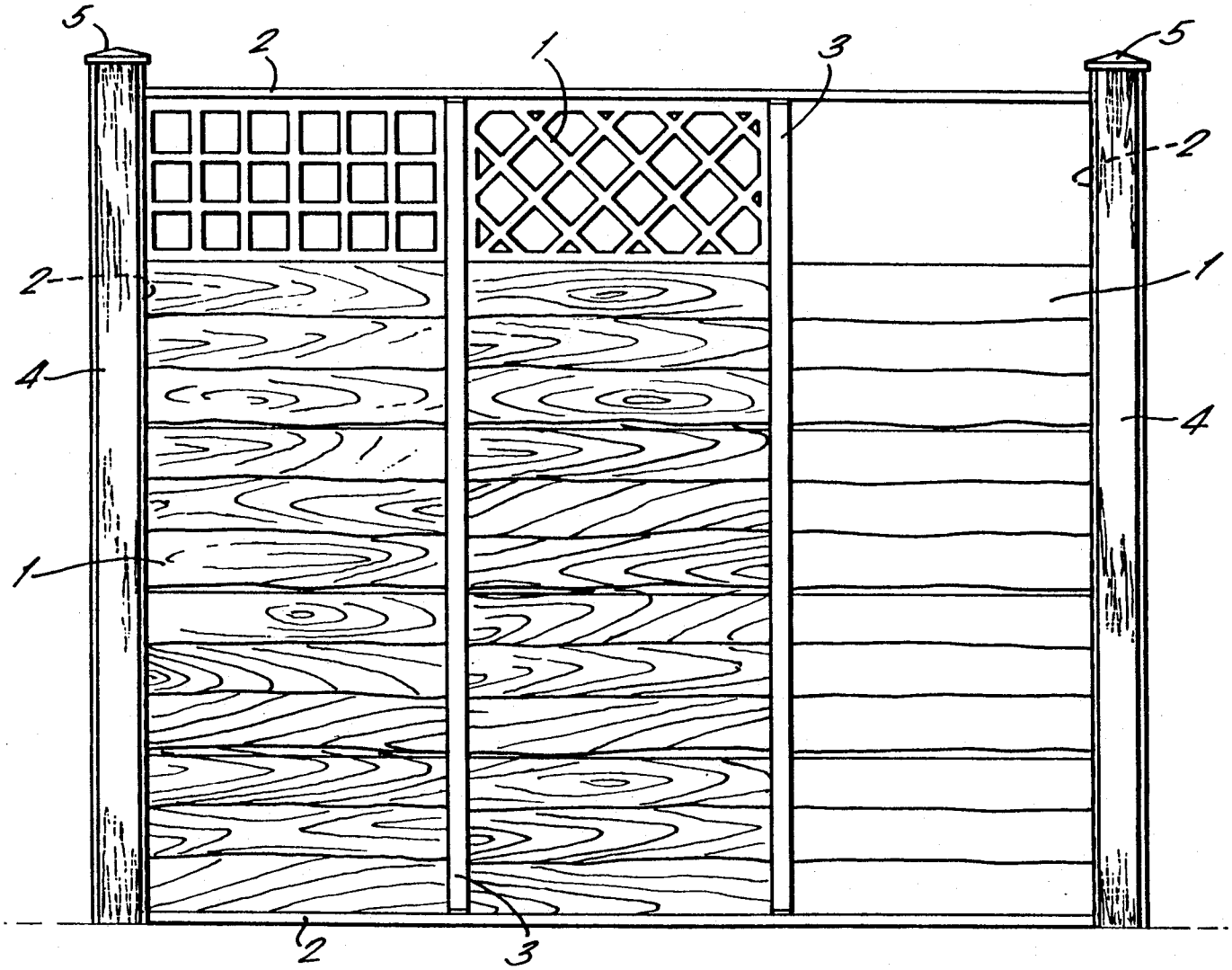
FIG. 1 shows a composite fence panel mounted between a pair of posts assembled from a system according to the invention.

FIG. 1 shows a composite fence panel assembled from fifteen sub-panels 1 mounted between four panel frame side members 2, the sub-panels 1 being arranged in three colums each of five sub-panels 1, with the colums being separated by panel frame intermediate members 3. The composite panel is mounted between a pair of posts 4, each having a cap 5, the posts being mounted in the ground 100. As shown in FIG. 1, the sub-panels 1 can be formed to simulate overlapping wooden panels, as shown for the lower sub-panels in each column, as trellis panels, as shown at the top of the left hand and centre columns, or as a plain panel, as shown at the top of the right hand column. It will be appreciated that FIG. 1 shows a composite panel in order to show some of the various possible sub-panels, and that for use a panel could be assembled from any desired combination of sub-panels.

All of the components of the assembly of FIG. 1 are formed of plastics material, and it will be appreciated that in the disassembled state all of the components of the assembly are of such a size as to be easily transportable.

Figure 2:
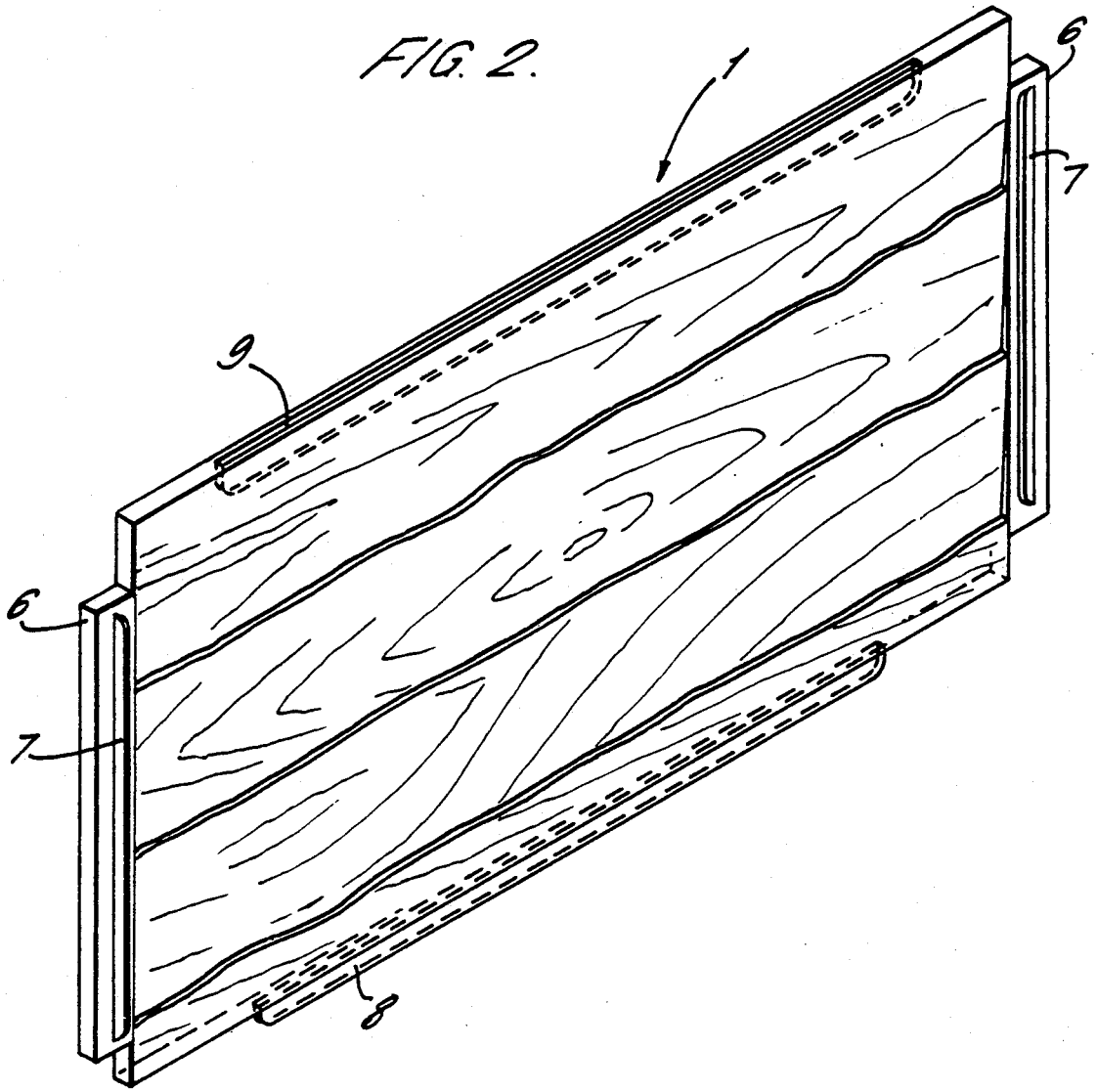
FIG. 2 is a perspective view of a sub-panel of the panel of FIG. 1.

Referring now to FIG. 2, this shows a typica sub-panel 1 for use in the assembly of FIG. 1. The sub-panel 1 is injection moulded from plastics material to simulate three overlapping wooden pieces. The sub-panel 1 is substantially planar and rectangular in shape, and has a pair of opposed edge portions in the form of flanges 6 formed with ribs 7, the flanges 6 being for receipt in channels in panel side members as will be described below. The other pair of opposed edges of the sub-panel 1 are formed with a tongue 8 and a corresponding slot 9 respectively whereby the tongue 8 of one sub-panel in a column of a panel can be received in the slot 9 of an adjacent sub-panel 1 thereby to secure the sub-panels 1 together at least against relative lateral movement.

Figure 3:
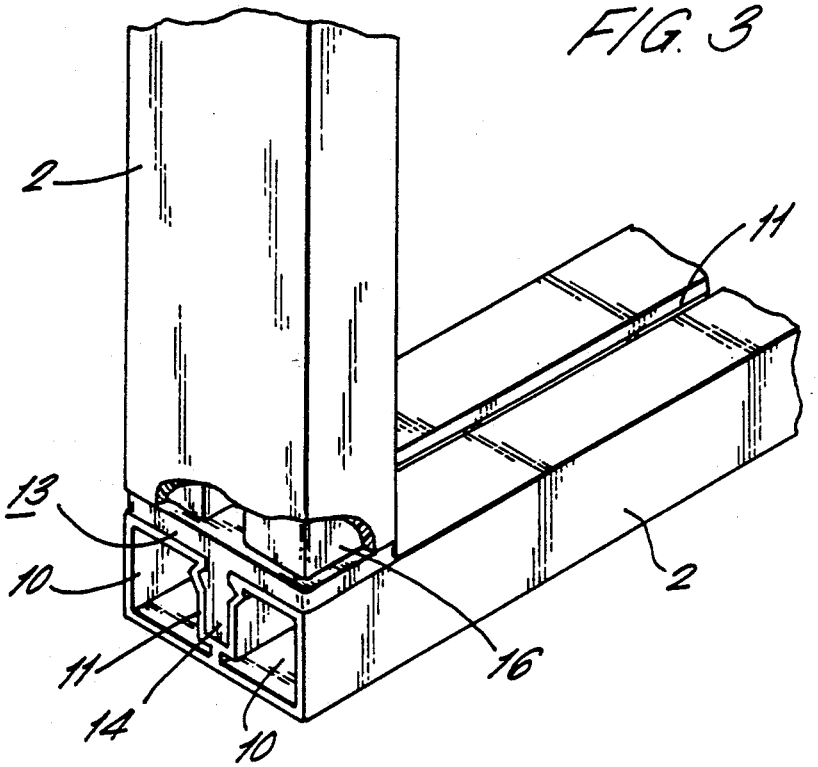
FIG. 3 is a perspective view of a corner of the frame of the panel of FIG. 1, with part broken away to show the manner in which the side members of the frame are secured together.
Figure 4:
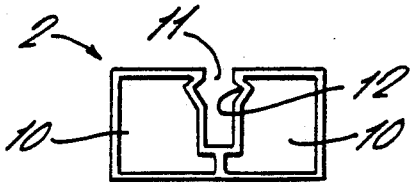
FIG. 4 is an end view of a side member of FIG. 3.

Referring now to FIG. 3, this shows a corner joint between two panel frame members 2 of the assembly of FIG. 1. As shown each side member 2 is an elongate hollow section extruded plastics material member having a pair of closed sections 10 with a channel 11 open to one edge of the member 2 extending between them. The cross-section of a panel frame side member 2 is clearly shown in FIG. 4. The channel 11 is sized to receive the flanges 6 of the sub-panels (see FIG. 2), and as best seen in FIG. 4, has an inner portion 12 of increased width to receive the ribs 7 on the flanges 6 of sub-panels 1.

Figure 5:
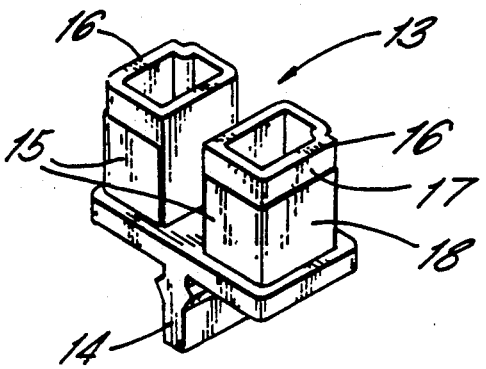
FIG. 5 is a perspective view of a joint member used in the corner of FIG. 3.

As shown in FIG. 3, at the corner the side members 2 are joined by a joint member 13 which is shown in FIG. 5. The joint member 13 is injection moulded from plastics material and has a first portion 14 for receipt in the channel 11 of a first side member 2, and a second portion 15 for receipt in the hollow section of the second side member 2 at the corner. The second portion 15 comprises two hollow projections 16 shaped for receipt in the two closed sections 10 of a side member 2 respectively. Each projections 16 is of stepped shape providing a free end portion 17 of relatively small cross-section for ease of insertion into a hollow section 10 of a side member 2, and an inner portion 18 of relatively large cross-section for gripping by the hollow section 10 of a side member 2 after insertion thereinto. As clearly shown in FIGS. 3 and 4, the first portion 14 of the joint member 13 is shaped to engage in the increased width portion 12 in the channel 11 in a side member 2 whereby the joint member 13 becomes secured in the channel 11 when the first portion 14 is inserted therein.

Figure 6:
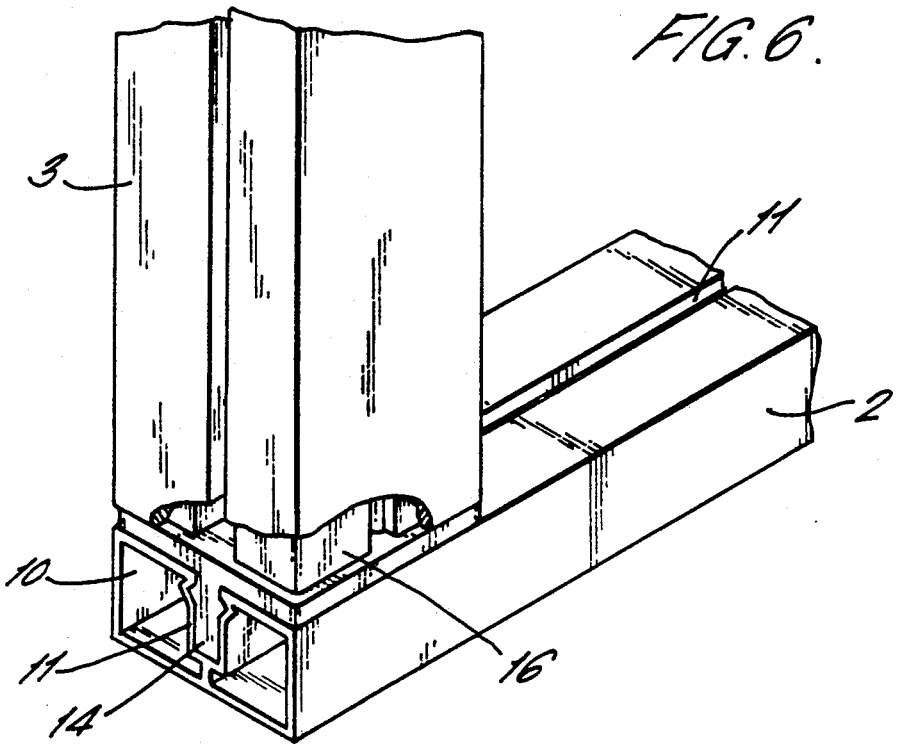
FIG. 6 is a perspective view of a joint between a side member and an intermediate frame member as used in the panel of FIG. 1, with part broken away to show the manner in which the members are secured together.
Figure 8:
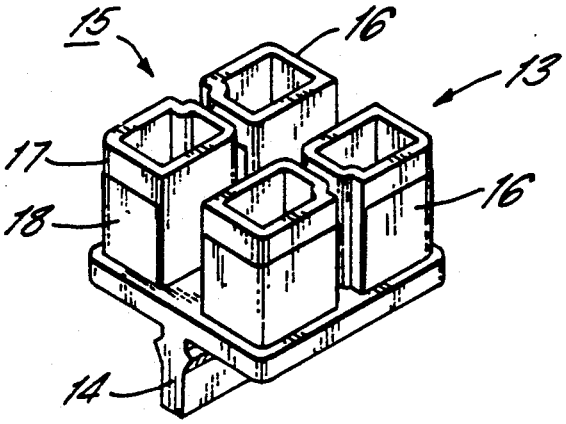
FIG. 8 is a perspective view of a joint member used in the joint of FIG. 6.
Figure 7:
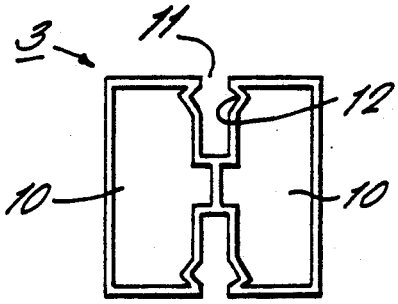
FIG. 7 is an end view of an intermediate member of FIG. 6.

FIG. 6 shows a joint between a side member 2 and a panel frame intermediate member 3 of the assembly of FIG. 1. The joint is similar to that shown in FIG. 3, and corresponding parts and features have been given the same reference numerals as in FIG. 3. The intermediate member 3 is an elongate hollow section plastics material extrusion having basically the form of a pair of panel frame side members 2 as shown in FIG. 3 arranged back-to-back, whereby the intermediate member 3 provides a pair of opposed channels 11 for receipt of the flanges 6 on sub-panels 1. The cross-section of the intermediate member 3 is clearly shown in FIG. 7. As shown in FIG. 8, the joint of FIG. 6 uses a joint member 13 similar to that of FIG. 5 except that the second portion 15 thereof comprises four hollow projections 16 instead of two.

Referring now to FIG. 9, this shows a post 4 of the assembly of FIG. 1, the post 4 being an elongate hollow section plastics material extrusion, having a cross-section as shown in FIG. 10, filled with a rigid foamed plastics material core 19. As shown a pair of opposed sides of the post 4 are each formed with a longitudinally extending channel 20 for receipt of an edge portion of a panel as shown in FIG. 1. The channel 20 in fact receives the side member 2 at the edge of the panel and thus the joints at the corners of the panel are concealed within and protected by the walls of the channel 20.

FIG. 11 shows a cap 21 for mounting on top of the post 4 of FIG. 9, the cap 21 being moulded from plastics material and having four pairs of co-operating flanges 22 and 23 arranged such that one flange 22 enages the inside surface of a side wall of the post 4 while the other flange 23 engages the outside surface thereof in opposed manner wherby the side wall is gripped between the flanges 22 and 23. The inner flanges 22 are formed with tapered edges to assist in penetration of the core 19 of the post 4.

FIG. 12 shows an alternative form of joint member 24 for joining side members 2 at the corners of a panel. This joint member 24 is moulded from plastics material and has a rectanguloid body 25 from which project two pairs of hollow projections 26, the pairs extending at right angles relative to each other. The projections 26 are received in the hollow sections 10 at the ends of a pair of side members 2 thereby to form a corner joint. The projections 26 can if desired be shaped as are the projections 16 of the joint member 13 of FIG. 3.

We claim:

1. A panel system comprising a plurality of posts and at least one panel for securing between a pair of adjacent posts, in which each post is formed from plastics material and has a channel in at least one edge to receive an edge portion of a panel, and each panel is formed from plastics material and comprises a plurality of sub-panels and a frame formed from a plurality of side members having similar cross-section secured together at corners of the frame, the plurality of sub-panels secured within the frame wherein each panel frame side member is formed with a channel open to one edge of the side member to receive edge portions of the sub-panels making up the panel.

2. A system as claimed in claim 1, in which each post is a hollow section extruded member.

3. A system as claimed in claim 2, in which each post is filled with a rigid foamed plastics material.

4. A system as claimed in claim 1, in which each panel frame side member is a hollow section extruded member.

5. A system as claimed in claim 4, in which the panel frame side members are secured together at the corners of the panel by joint members each having a first portion for receipt in the channel of a first panel frame side member, and a second portion for receipt in the hollow section of the second panel frame second side member at the corner.

6. A system as claimed in claim 5, in which the second portion of each joint member is of stepped shape providing a free end portion of relatively small cross-section for ease of insertion into the hollow section of a panel frame side member, and an inner portion of relatively large cross section for gripping by the hollow section of a panel frame side member.

7. A system as claimed in claim 5, in which the channel in each panel frame side member has an inner portion of increased width, the first portion of each joint member being correspondingly shaped whereby the first portion of a joint member becomes secured in the channel in a panel frame side member when inserted therein.

8. A system as claimed in claim 5, in which each panel frame side member comprises a pair of closed sections with the channel extending between them.

9. A system as claimed in claim 8, in which the second portion of each joint member has two parts for receipt in the two closed sections of a panel frame side member respectively.

10. A system as claimed in claim 4, in which each sub-panel has a pair of opposed edge portions in the form of flanges for receipt in the channels of a pair of opposed panel frame side members.

11. A system as claimed in claim 10, in which the flanges of each sub-panel have ribs thereon providing an interference fit of the flanges in the channels in the panel frame side members.

12. A system as claimed in claim 10, in which the other pair of opposed edges of each sub-panel are formed with a tongue and a corresponding slot respectively whereby the tongue of one sub-panel can be received in the slot of an adjacent sub-panel thereby to secure the two sub-panels together.

13. A post, for use in a system as claimed in claim 1, comprising an elongate hollow section plastics material extrusion filled with a rigid foamed plastics material, a pair of opposed sides of the post each being formed with a longitudinally extending channel for receipt of an edge portion of a panel.

14. A post as claimed in claim 13, in which each channel is of inwardly stepped configuration thereby to provide for ease of insertion and subsequent gripping of a panel edge portion.

15. A panel frame side member, for use in a system as claimed in claim 1, comprising an elongate hollow section plastics material extrusion having a longitudinally extending pair of closed sections having a longitudinally extending channel therebetween for receipt of edge portions of sub-panels.

16. A panel frame side member as claimed in claim 15, in which the channel has an inner portion of increased width.

17. A sub-panel, for use in a system as claimed in claim 1, comprising a plastics material moulding having a pair of opposed edge side portions for receipt in channels in a pair of panel frame side members respectively.

18. A sub-panel as claimed in claim 17, in which the edge portions comprise flanges formed with ribs for gripping within the channels in the panel frame side members.

19. A sub-panel as claimed in claim 17, in which the other pair of opposed edges are formed with a tongue and a corresponding slot respectively whereby the tongue of one sub-panel can be received in the slot of an adjacent sub-panel thereby to secure the two sub-panels together.

20. A sub-panel as claimed in claim 17 formed to simulate a wooden panel.

21. A sub-panel as claimed in claim 17 in the form of a trellis panel.

22. A joint member, for use in a system as claimed in claim 5, comprising a plastics material moulding having a first portion for receipt in a channel in a first panel frame side member, and a second portion for receipt in the end of a second hollow section panel frame side member.

23. A joint member as claimed in claim 22, in which the second portion is of stepped shape providing a free end portion of relatively small cross-section for ease of insertion into the hollow section of the second panel frame side member, and an inner portion of relatively large cross-section for gripping by the hollow section of the second panel frame side member.

24. A joint member as claimed in claim 22, for use with a first panel frame side member comprising an elongate hollow section plastic material extrusion having a longitudinally extending pair of closed sections having a longitudinally extending channel therebetween for receipt of edge portions of sub-panels, the channel having an inner portion of increased width, said joint member having a first portion shaped to co-operate with the inner portion of increased width of the channel in the panel frame side member thereby to become secured in the channel when inserted therein.

25. A panel system comprising a plurality of posts and at least one panel for securing between a pair of adjacent posts, in which each post is formed from plastics material and has a channel in at least one edge to receive an edge portion of a panel, and each panel is formed from plastics material and comprises a frame formed from a plurality hollow extruded side members of similar cross-section secured together at corners of the frame by joint members having portions received in the hollow section of each of the two side members at the corner, and a plurality of sub-panels secured within the frame.

26. A system as claimed in claim 25, in which said portions of the joint members are of stepped shape providing a free end portion of relatively small cross-section for ease of insertion into the hollow section of a panel frame side member, and an inner portion of relatively large cross-section for gripping by the hollow section of a panel frame side member.

27. A panel system comprising a plurality of posts and at least one panel for securing between a pair of adjacent posts, in which each post is formed from plastics material and has a channel in at least one edge to receive an edge portion of a panel, and each panel is formed from plastics material and comprises a frame formed from a plurality of similar cross-section side members secured together at corners of the frame, and a panel frame intermediate member extending across the panel with a plurality of sub-panels secured within the frame on either side of the intermediate member.

28. A system as claimed in claim 27, in which each panel frame intermediate member has the form of a pair of panel frame side members arranged back-to-back.

29. A panel frame intermediate member, for use in a system as claimed in claim 27, comprising an elongate hollow section plastics material extrusion having the form of a pair of panel frame side members, each comprising an elongate hollow section plastic material extrusion having a longitudinally extending pair of closed sections having a longitudinally extending channel therebetween for receipt of edge portions of sub-panels, said panel frame side members being arranged back-to-back with their channels open to a pair of opposed sides of the members.

* * * * *